US005795391A

United States Patent [19]

Niemann et al.

[11] Patent Number: 5,795,391

[45] Date of Patent: Aug. 18, 1998

[54] METHOD AND APPARATUS FOR APPLICATION OF FLUENT MATERIAL TO A MOVING SUBSTRATE

[75] Inventors: Frederic J. Niemann; Wolfgang K. F. Otto, both of Spartanburg, S.C.

[73] Assignee: Consultex Corporation, Spartanburg, S.C.

[21] Appl. No.: 619,991

[22] Filed: Mar. 21, 1996

[51] Int. Cl.[6] ..... B05C 5/00; D06B 1/02

[52] U.S. Cl. ..... 118/315; 118/325; 68/205 R

[58] Field of Search ..... 118/313, 314, 118/315, 323, 324, 325; 28/184, 178; 68/5 D, 200, 205 R; 8/148, 151, 158; 239/543, 544, 548, 568

[56] References Cited

U.S. PATENT DOCUMENTS

| | | | |
|---|---|---|---|
| 3,014,812 | 12/1961 | Sallie | 117/24 |
| 3,749,313 | 7/1973 | Weitmann | 239/127 |
| 3,899,903 | 8/1975 | Lapierre | 8/149.1 |
| 4,006,858 | 2/1977 | Farmery | 239/7 |
| 4,338,376 | 7/1982 | Norton | 118/323 |
| 4,368,849 | 1/1983 | Farmery | 239/222 |
| 4,502,634 | 3/1985 | Bals | 239/223 |
| 4,540,124 | 9/1985 | Haruch | 239/223 |
| 4,795,095 | 1/1989 | Shepard | 239/214.17 |
| 4,803,746 | 2/1989 | Bryant | 68/205 R |
| 4,874,390 | 10/1989 | Legault | 68/205 |
| 5,110,632 | 5/1992 | Kawaguchi et al. | 427/424 |

FOREIGN PATENT DOCUMENTS

| | | |
|---|---|---|
| 2058667 | 5/1972 | Germany . |
| 2207102 | 8/1973 | Germany . |
| 534051 | 4/1973 | Switzerland . |
| 94/04364 | 3/1994 | WIPO . |

OTHER PUBLICATIONS

Twelve pages (hand numbered) of a brochure entitled "Rotor damping system for the application of liquids, WEKO".

Four page brochure, "IQ–120 The Intelligent Rotary Spray System, Jul. 15, 1992, Consultex Corporation, Spartanburg, SC 29304–5751.

Four page brochure, "IQ–120 The Intelligent Rotary Spray System, Consultex Corporation, Spartanburg, SC 29304–5751.

Twelve page brochure, Rotor damping system for the application of liquids", Weitmann & Konrad, Germany.

*Primary Examiner*—Laura Edwards
*Assistant Examiner*—Calvin Padgett
*Attorney, Agent, or Firm*—Luke J. Wilburn, Jr.

[57] ABSTRACT

Apparatus for applying fluent material to a moving surface comprising a housing having an elongated continuous opening therein positioned adjacent to and extending generally transversely across the path of a moving surface, a row of rotatable spray heads mounted in the housing for rotation about parallel axes and positioned along the elongated opening to direct fluent material through the elongated opening and onto the moving surface, with next adjacent spray heads rotating in opposite directions to centrifugally discharge fluent material onto the moving surface in multiple overlapping patterns to blend the material in a substantially uniform concentration across the width of the moving surface.

12 Claims, 12 Drawing Sheets

METHOD AND APPARATUS FOR APPLICATION OF FLUENT MATERIAL TO A MOVING SUBSTRATE

The present invention is directed to method and apparatus for applying fluent materials to a moving surface and, more particularly, to an improved method and apparatus for applying fluent material, such as treating liquid, to a moving substrate, such as a fabric or sheet of material, in a uniform manner.

BACKGROUND OF THE INVENTION

It has been known to apply fluent materials to moving surfaces, such as rolls, fabrics, and web materials, by centrifugal force by expelling the fluent materials from rotatable bodies, such as rotating spray heads in the form of discs. Application by centrifugal force from rotating discs finds advantage over fixed spray nozzles by eliminating clogging of narrow nozzle openings, and by eliminating the need of compressed air or other pressure source to force the liquid through the spray nozzles.

One such centrifugal spray apparatus is disclosed in U.S. Pat. No. 3,749,313. As described therein, the apparatus for moistening a moving surface consists of a housing extending across the path of movement of a moving surface and containing a plurality of rotatable spray heads, or discs, mounted for rotation on parallel axes to deliver a portion of liquid spray centrifugally expelled from each spray head through a corresponding adjustable open window of the housing. The width of each window in the housing through which the liquid spray passes from each rotating spray head is to be adjusted so that the width of each spray stream striking the moving surface abuts its next adjacent spray stream across the moving surface to be treated to facilitate uniform distribution of liquid across the width of the surface.

Further modifications of the apparatus disclosed in the aforesaid patent have employed multiple rows of side-by-side rotating discs extending across the surface to be treated and spaced therealong in the direction of surface movement, with the width of the spray from each rotating disc being controlled by its adjustable window to abut spray streams of adjacent discs in each row and uniformly apply the liquid to the surface.

Although such apparatus have been used commercially with same success, it has been found that if there is a slight change or variation in the distance between the moving surface and the housing windows during its passage thereby, then spray streams from adjacent rotating discs in each row will not exactly abut each other on the moving surface, but will overlap or gap with the adjacent stream, thus causing an overlap or a gapping of the liquid streams on the moving surface. Further, it has been found that it is difficult to accurately adjust the width of the window of each spray head to achieve exact abutment of adjacent spray streams on the moving surface, resulting in stream overlap or gap, with consequent non-uniformity of liquid application to the receiving surface.

As a further problem, the amount of fluent material applied through each window onto the moving surface varies across the width of the spray stream striking the surface, due to the amount of fluent material on the upper surfaces of each disc of the rotating spray heads lessening as the disc rotates away from the point of introduction of liquid onto their upper surface from a supply source. In other words, the amount of liquid being centrifugally discharged from the periphery of the disc decreases as the disc rotates away from the point of introduction of liquid onto the disc.

Such is particularly undesirable when uniformity of application is essential, as in a fabric dyeing operation where visual streaks or gaps will appear in the fabric.

BRIEF OBJECTS OF INVENTION

It is therefore an object of the present invention to provide improved apparatus for applying fluent material uniformly across the width of a moving surface by centrifugal force which is of simplified construction and does not require the use of adjustable housing discharge windows or the precise control of the distance between the housing, rotating discs, and the moving surface to be treated.

It is another object to provide an improved method and apparatus for centrifugal force application of fluent materials to moving surfaces wherein the fluent material may be uniformly applied to the moving surface in higher amounts per given time than heretofore applied by the aforementioned prior art, allowing greater production speeds of treated surfaces.

It is a further object to provide improved apparatus for application of fluent materials to moving substrates, such as webs and fabrics, whereby the application of the fluent material by centrifugal force is unrestricted in its passage onto the moving surface by adjustable windows, such that the fluent material from multiple spray heads overlap to facilitate uniform blending of multiple stream patterns deposited on the moving surface.

It is a further object to provide improved apparatus for application of fluent material to a moving surface which apparatus is more economical to manufacture, and is easier to adjust and to operate than similar centrifugal-type apparatus of the prior art.

It is a still further object to provide improved apparatus for applying fluent material uniformly across the width of a moving surface, such as a substrate material, by centrifugal force, which apparatus may be angularly adjusted within limits to apply the fluent material to a surface moving in selected paths of travel from horizontal to vertical planes, and which apparatus can apply the fluent material against the moving surface at selected angles with respect thereto.

BRIEF DESCRIPTION OF THE DRAWINGS

The above as well as other objects of the invention will become more apparent, and the invention will be better understood, from the following detailed description of preferred embodiments of the invention, when taken together with the accompanying drawings, in which.

SUMMARY OF THE INVENTION

The present invention comprises improved apparatus for applying fluent material to a moving surface including a housing having an elongated continuous opening therein positioned adjacent to and extending generally transversely across the path of travel of a moving surface, and a row of rotatable spray heads mounted in the housing for rotation about parallel axes are positioned along the elongated opening. Fluent material, such as a treating liquid composition, is continuously supplied to each of the rotatable spray heads and the heads are rotated so that next adjacent rotatable spray heads in the row are rotated in opposite directions to centrifugally discharge fluent material through the elongated opening and onto the moving surface. The rotatable spray heads are located, configured, and arranged so that fluent material from the rotatable spray heads passing through the housing opening strikes the moving surface in multiple overlapping patterns to blend the fluent material in a substantially uniform concentration across the width of the moving surface.

DETAILED DESCRIPTION OF PREFERRED EMBODIMENTS

Figure 1:
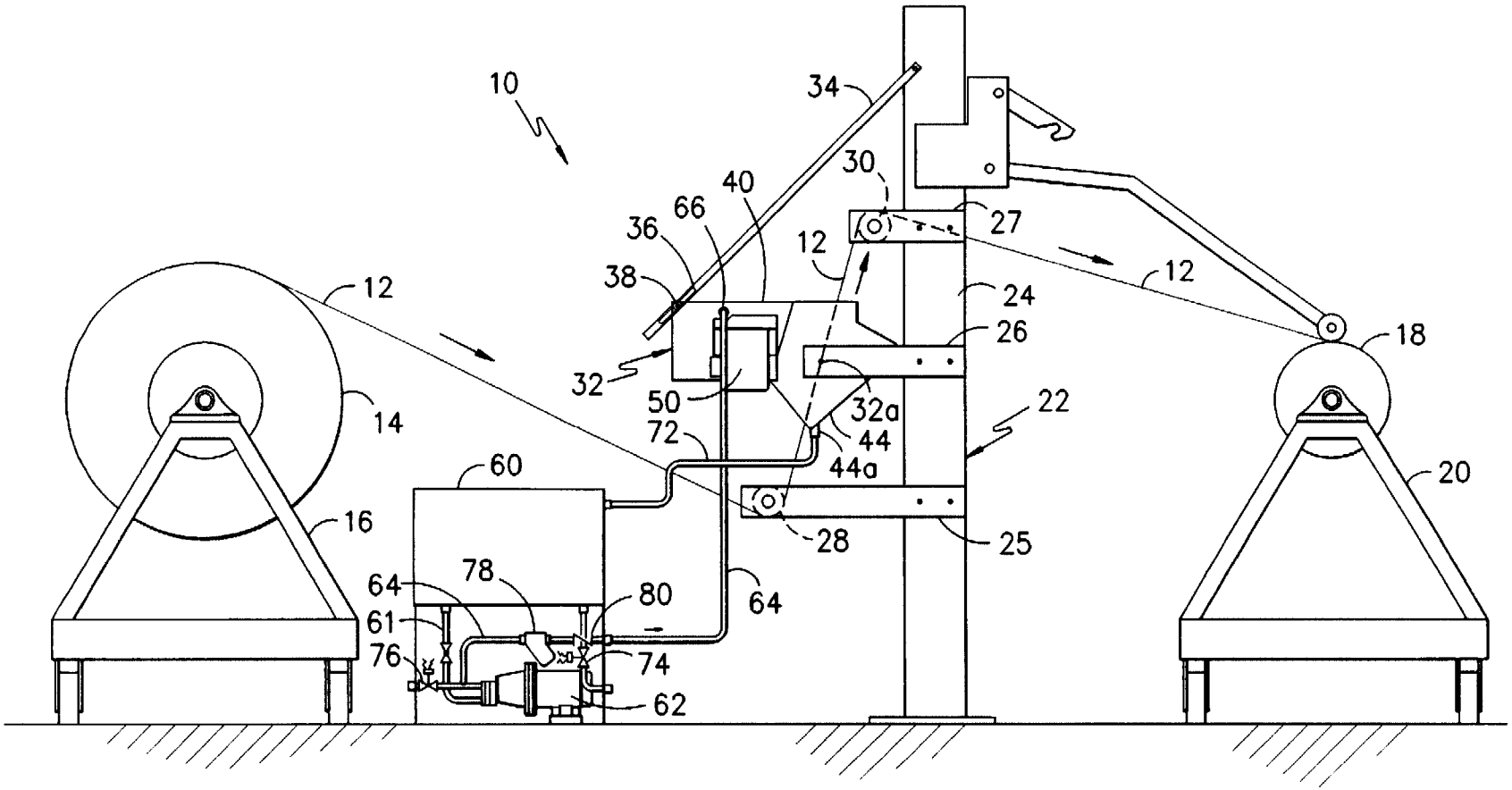
FIG. 1 is a diagrammatic side elevation view of a first embodiment of apparatus of the present invention for applying fluent material to a moving substrate, such as a continuous length sheet or fabric.

Referring now to the drawings, FIG. 1 is a diagrammatic side elevation view of a first embodiment of apparatus 10 of the present invention for applying fluent materials to a moving surface. As shown, a moving surface, such as a continuous length of a knitted or woven fabric 12, is provided from a delivery roll 14 rotatably mounted on a delivery roll stand 16. The treated fabric 12 is collected on a take-up roll 18 rotatably mounted on a take-up roll stand 20. Take up roll 18 is rotatably driven by suitable means, such as an electric motor, not shown. Treating apparatus 10 includes a main support frame 22 having vertical and horizontal support members 24–27. Fabric guide rollers 28, 30 extending across the fabric path are mounted at their end for rotation on suitable support members of the support frame and may be adjustably positioned on the frame to guide fabric 12 in a desired path of travel through a fluent material applicator section 32. Applicator section 32 extends transversely across the path of movement of the fabric and is mounted at its ends on the support frame for rotational adjustment about a central horizontal axis 32*a* parallel to the plane of the fabric path. A support arm 34 at each end of applicator section 32 is pivotally attached to the support frame 24 and attached to upper ends of the liquid applicator section 32 by elongated slots 36 with fastening bolts 38 to support the section at a desired angular position about axis 32*a*.

As best seen in FIGS. 1–5, a first embodiment of applicator section 32 comprises a support housing 40 having end plates 41 and containing a row of rotary spray heads 42 for applying fluent material, such as a treating liquid composition, onto the surface of the fabric 12. The spray heads are mounted in side-by-side straight-line relation on a sub-housing support 40*a* (FIG. 5) and are positioned in a row alongside an elongated continuous slot 40*b* in the housing. During movement past the row of spray heads, the fabric 12 passes through a shroud enclosure 44 fixedly attached to housing 40. The shroud 44 extends across the path of movement of the fabric to enclose a portion of the path. Shroud 44 has a fabric entrance slot 46 and an exit slot 48. The shroud 44 provides for collection and recovery of excess treating liquid discharged from the spray heads 42, as will be explained.

Located within the housing (FIG. 5) is an elongated baffle plate 40*c* and a liquid catch lip 40*d* which serves to intercept and deflect any vapors and air-entrained liquid in the housing for collection and delivery through housing drain openings 40*e* (FIGS. 3 and 4) into shroud 44.

Figure 3:
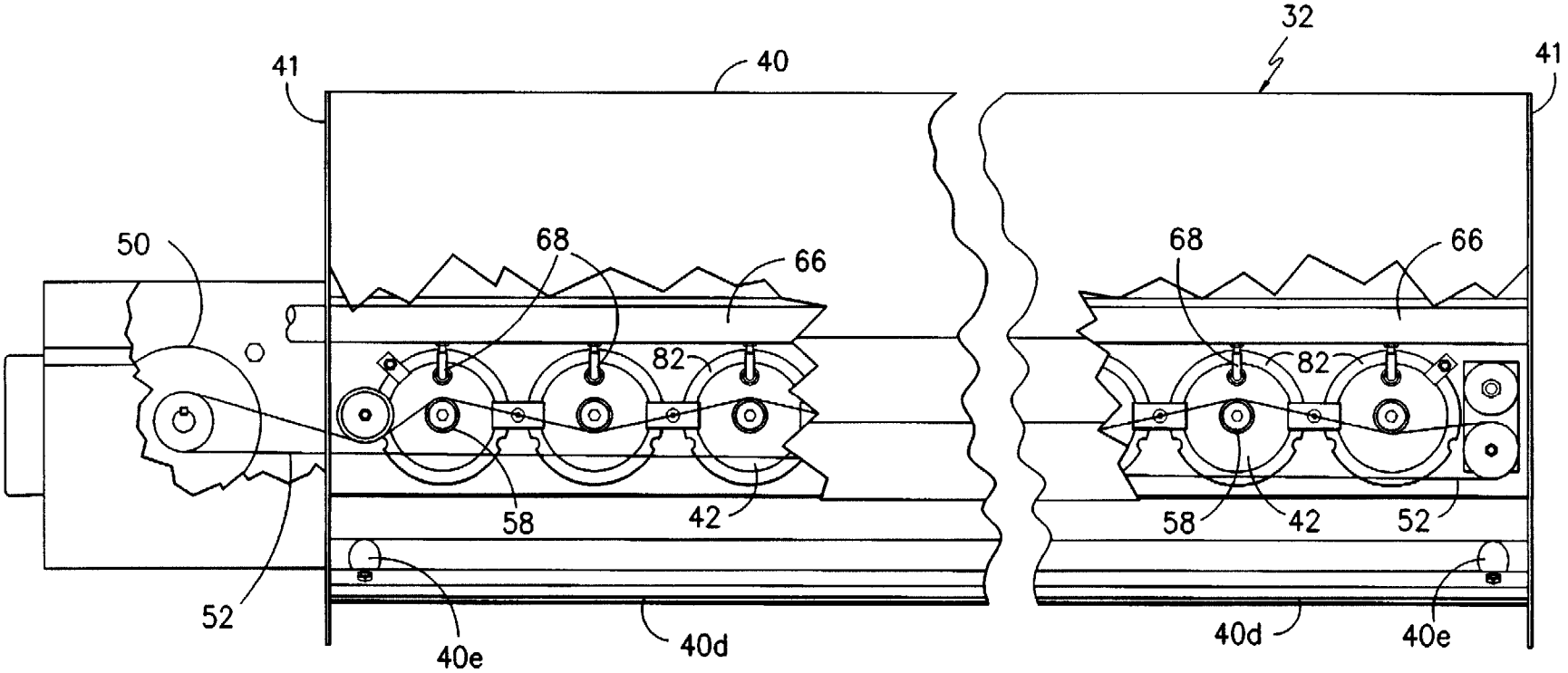
FIG. 3 is a further enlarged, top plan view of the applicator section of FIG. 1, with a mid-portion of the applicator section removed, shroud of the section removed, and with portions of the housing of the section broken away.
Figure 4:
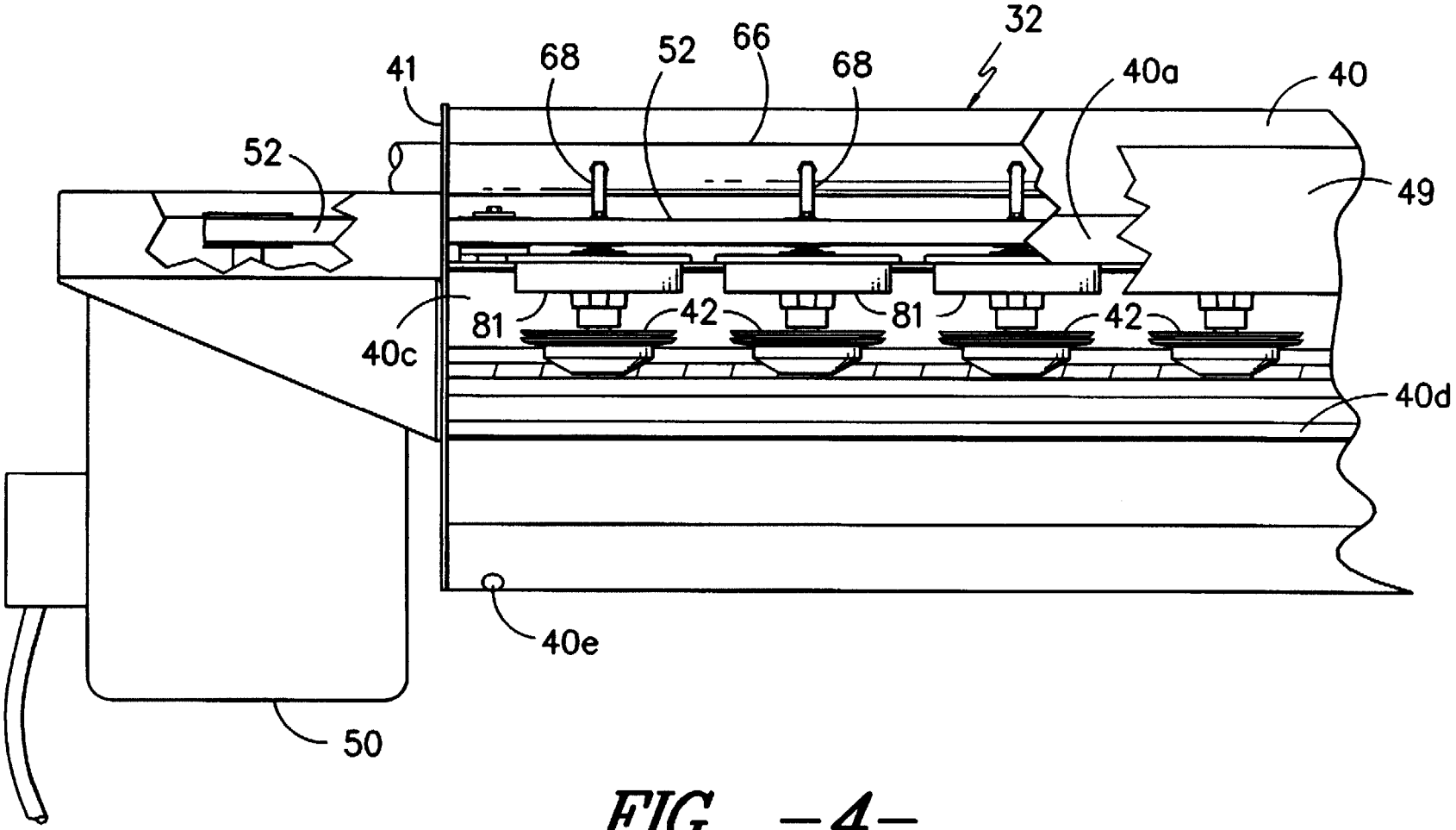
FIG. 4 is an enlarged right-side elevation view (as seen in FIG. 1) of a left-hand portion of the applicator section, with shroud removed and with portions of the housing broken away to show interior components thereof.
Figure 5:
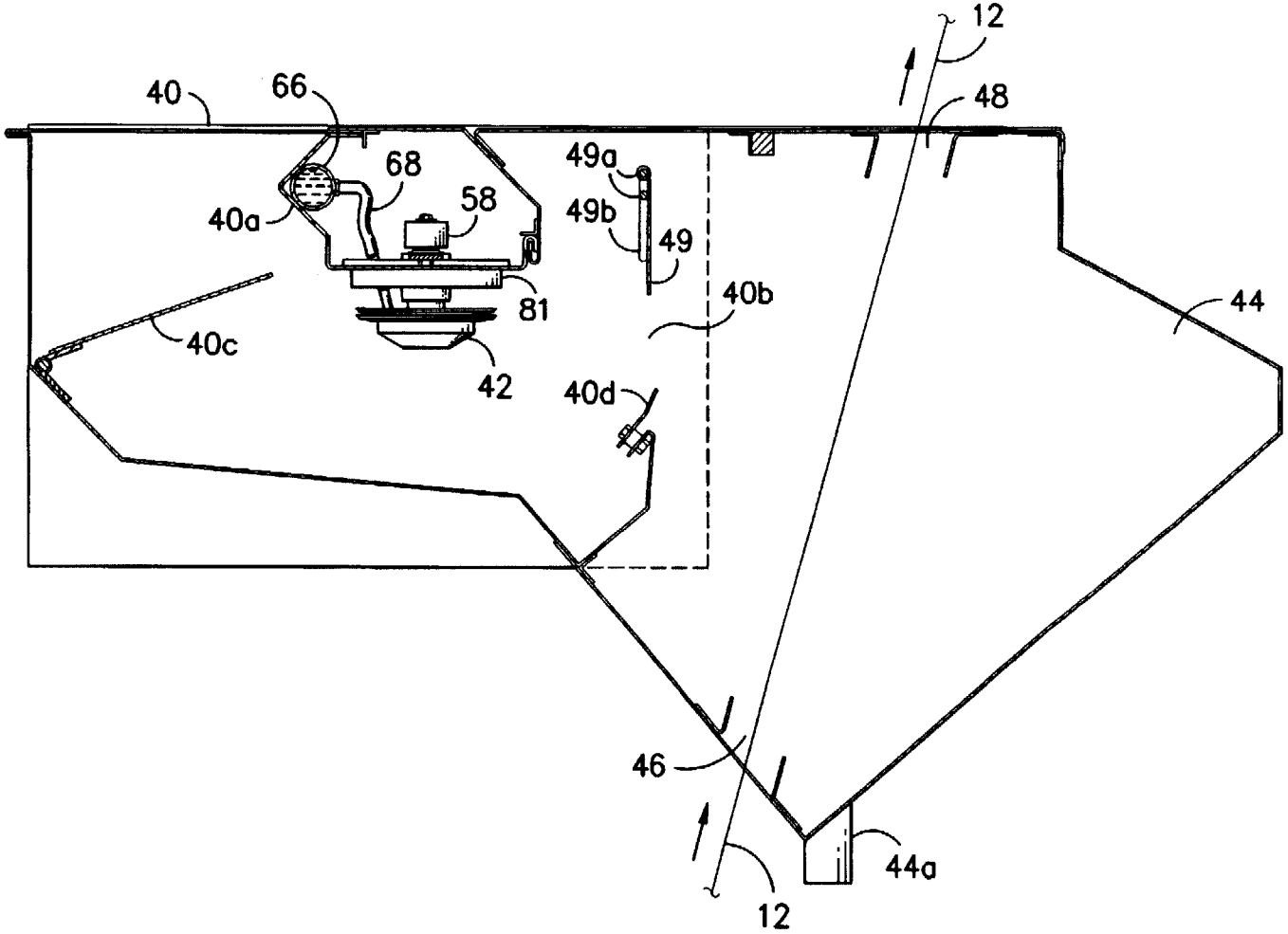
FIG. 5 is an enlarged vertical sectional elevation view of the applicator section taken generally along line V—V of FIG. 2.

Located above liquid catch lip 40*d* is an adjustable elongate wall section 49 (FIGS. 4 and 5). Catch lip 40*d* and wall section 49 form elongate housing opening 40*b* therebetween. Wall section 49 is attached to opposite end plates 41 of the housing by rods 49*a* (FIG. 5) which may be adjustably positioned along slots 49*b* in the end plates 41 of the housing to lower wall section 49 and close the spray head discharge slot 40*b* at times of start up and stop of the applicator section. In this way treating liquid can be diverted from contact with fabric 12 and recirculated to a liquid supply tank 60 through housing drain openings 40*e* (FIG. 3) and shroud liquid outlet openings 44*a* (FIGS. 1 and 5), as will be explained.

Figure 2:
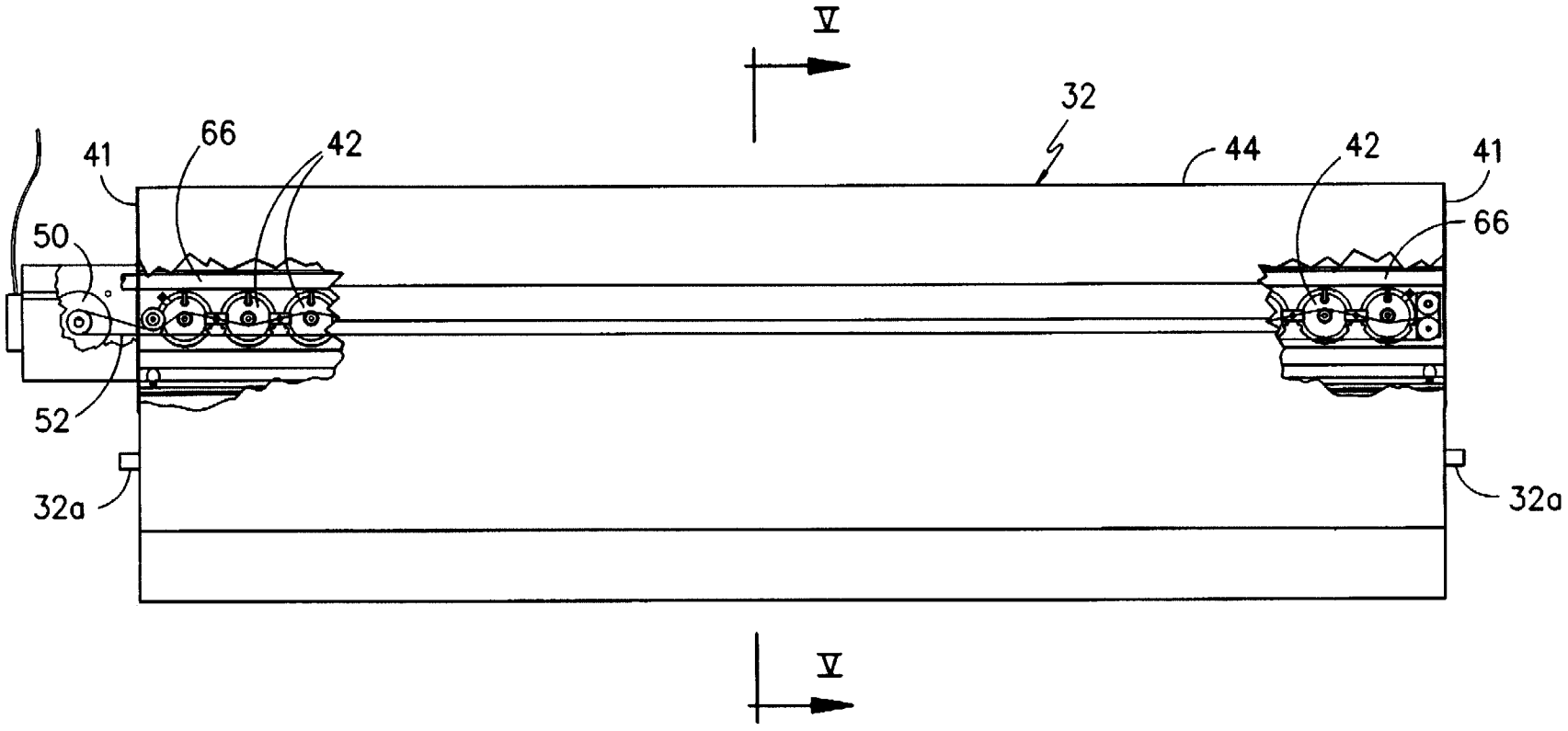
FIG. 2 is an enlarged top plan view of the fluent material applicator section of the apparatus seen in FIG. 1.
Figure 6:
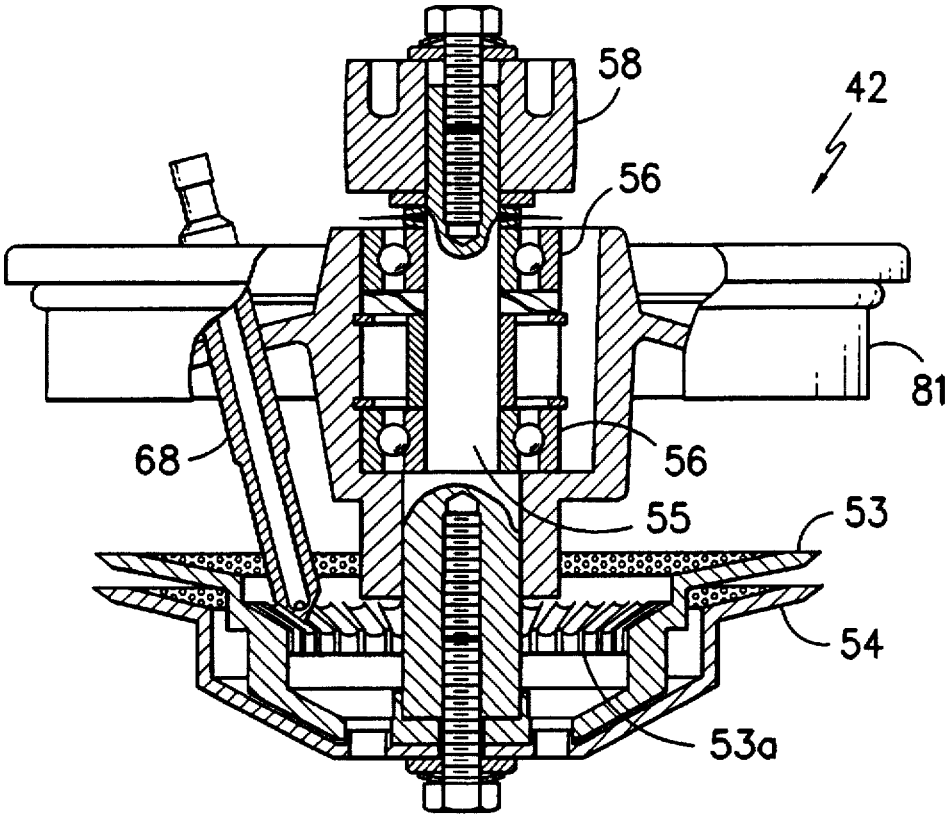
FIG. 6 is an enlarged, side elevation view, with portions in section, of one of the rotary spray heads employed to apply fluent material to a moving substrate.

FIGS. 2 and 3 are top plan views, and FIG. 4 is a side elevation view of the applicator section 32, with portions removed or broken away to better show the interior components of the support housing 40. Each of the rotary spray heads 42 in the housing is rotated about its central rotational axis by power means, such as an electric motor 50, which drives a continuous belt 52. As seen in FIGS. 4–6, each rotatable spray head 42 includes a pair of circular discs 53, 54 mounted on a central support shaft 55. Shaft 55 of each spray head is mounted in bearings 56 for rotational movement, and the drive belt 52 from the drive motor 50 engages the surface of a drive pulley 58 on each shaft 55. As shown in FIGS. 2–4, belt 52 is entrained about the pulleys 58 to rotate next adjacent rotatable spray heads of the row in opposite directions and the shafts 55 are located in a common plane.

As seen in FIG. 1, fluent material, such as a suitable treating liquid composition to be applied to the moving fabric, is supplied to applicator section 32 from a liquid supply tank 60 by way of conduit 61, a motorized pump 62, and a feed conduit 64 to an inlet manifold 66 extending the length of the applicator section (FIGS. 1–5). Manifold 66 supplies the treating liquid to each spray head 42 through individual spray head inlet lines 68. The spray heads are rotatably driven (with next adjacent spray heads rotating in opposite directions) to centrifugally discharge the treating liquid outwardly from their discs 53, 54. A portion of the discharged liquid passes through slot 40*b* (FIG. 5) to strike the moving fabric. Liquid discharged from the spray heads which does not contact the fabric, such as mist and liquid captured by the walls of housing 40, is collected in the housing 40 and shroud 44. Liquid collected in housing 40 passes through outlets 40*e* into shroud 44. Liquid collected in shroud 44 is recirculated, via outlet openings 44*a* at each end of the shroud and conduit 72, to supply tank 60 (FIG. 1). Appropriate float-operated solenoid valving 74 is provided to supply makeup liquid to the tank, as needed. Valve 76 drains the tank 60. A filter 78 and check valve 80 are provided in the supply conduit 64 to free the liquid of solid impurities and to maintain a head of liquid in the applicator section when pump 62 is not in operation.

Details of the spray heads are best seen in FIGS. 5 and 6. Each rotatable spray head 42 is attached by a support ring 81 affixed to sub-housing 40*a* of housing 40. Treating liquid is supplied to the upper surface of disc 53 through inlet line 68 and passes outwardly across the disc, during rotation of the head 42, to be discharged from the circumferential lip of the disc. A portion of treating liquid flowing into upper disc 53 also passes, via channels 53*a* having openings in their outer periphery, into the lower disc 54. In like manner, treating liquid passing onto the upper surface of the lower disc 54 is expelled outwardly from the circumferential lip of the lower disc. A portion of the centrifugally expelled liquid from the discs of the spray heads passes through the continuous elongated slot 40*b* of housing 40 into the shroud 44 to strike the surface of the moving fabric. That liquid which is expelled from the discs and does not pass through the elongated slot 40*b* is collected by the housing walls and drains through drainage openings 40*e* into the shroud. Liquid collected in the shroud is recirculated via the shroud outlets 44*a* and return line 72 to the liquid supply tank 60.

The spray heads 42 are arranged and spaced along continuous slot 40*b* so that their spray patterns overlap multiple spray patterns of spray heads in both directions. The result is that the deposition patterns of spray from multiple spray heads overlap on the surface of the fabric. To provide uniformity of application across the full width of a moving surface, it is desirable that the length of the row of spray heads exceeds the width of the fabric by additional spray heads on either side of the fabric, with excess spray outside the width of the fabric being collected for recirculation to the liquid supply tank 60.

In practical application, it has been found that the unrestricted discharge of spray from the multiple spray heads 42 through the elongated opening 40*b* with their overlap on the fabric surface provides better uniformity and greater control of uniformity than the aforementioned centrifugal spray apparatus employing multiple slots with width control windows. In addition, it has been found that the spray head-to-fabric distance can vary without adverse effects on uniformity of distribution of the liquid on the fabric.

By utilizing an unrestricted slot through which the spray streams can pass from the spray heads into the shroud, it has been found that considerably more liquid treating material may be applied to a moving surface, e.g., a fabric substrate, than heretofore has been applied with the aforementioned centrifugal spray apparatus employing slots with width control windows. A comparison of the amount of liquid application by the prior art device with liquid application of the present invention indicates that while only about 20% of the circulating liquid is discharged through width controlled windows of the prior art, up to 40% of the circulating liquid is discharged through the continuous unrestricted housing discharge slot 40*b* of the present invention.

Another important feature of the present invention resides in the fact that the angle of the spray from the spray heads relative to the plane of the fabric may be varied within certain limits of acute angularity, without affecting the apparent uniformity of distribution of spray across the fabric. Spray heads may be adjusted to effectively treat moving substrates having paths of travel in various directions, i.e., vertically, horizontally, or at any angle therebetween, with consequent improved benefits, as aforementioned.

The housing and the rotational axes of the row of spray heads also may be angularly adjusted, or tilted, from the vertical to vary the angle of application of the spray path relative to the plane of the fabric substrate. Such angles may be selected within limits dictated by undesired dripping of treating liquid from the rotating spray heads, on the one hand, and excessive length of spray path to fabric surface, on the other. For example, with spray heads having rotating discs of about 3" diameter and operating rotational speeds of between about three to five thousand RPM, the heads may be positioned and effectively operated at rotational shaft angles from the vertical to about 40° off the vertical (a 40° angle of spray path to the horizontal plane) without objectional drip of treating liquid from the spray head discs.

Practically, to avoid excessive length of spray path to fabric substrate surface and the corresponding increase in size of shroud required for such, the relative angle between the plane of the spray head discs (the spray path) and the plane of the fabric substrate should be greater than about 10°. Preferably, the center of the spray heads in straight line distance perpendicular from the substrate fabric should be from between about 6" to 24".

In establishing a desired spray path/fabric substrate path angular relation, the fabric inlet and exit slots 46, 48 in the shroud and guide rollers 28, 30 may be appropriately relocated from their positions shown in FIG. 1, to accommodate the particular fabric path and the desired relative angle between the discharge spray path and the plane of the fabric.

FIGS. 7–10 show a second embodiment of the present invention in which the applicator section of the invention is modified to provide relative positioning of the support housing and shroud enclosure of the applicator section. Like elements of the applicator section of the second embodiment to those of the embodiment shown in FIGS. 1–6 are identified by their prime numbers.

The applicator section 32' of FIGS. 7–10 is constructed with a shroud enclosure 82 communicating with the support housing 40' to permit relative adjustable positioning of the housing 40' and shroud 82. As seen in FIGS. 7–10, the housing and shroud enclosure are operatively interconnected by means of a continuous flexible member, such as a pleated rubber sleeve 83, opposed ends of which are attached, as by one or more clamp members 84, to the respective outer wall surfaces of the housing 40' and shroud 82. The pleated sleeve 83 serves as a liquid-tight connection between the housing and the open side of the shroud enclosure 82. This flexible connection permits relative adjustment of the housing 40' and the shroud 82 to treat moving surfaces, e.g., fabrics, in various planes of movement and at varying spray angles onto the surfaces.

Figure 7:
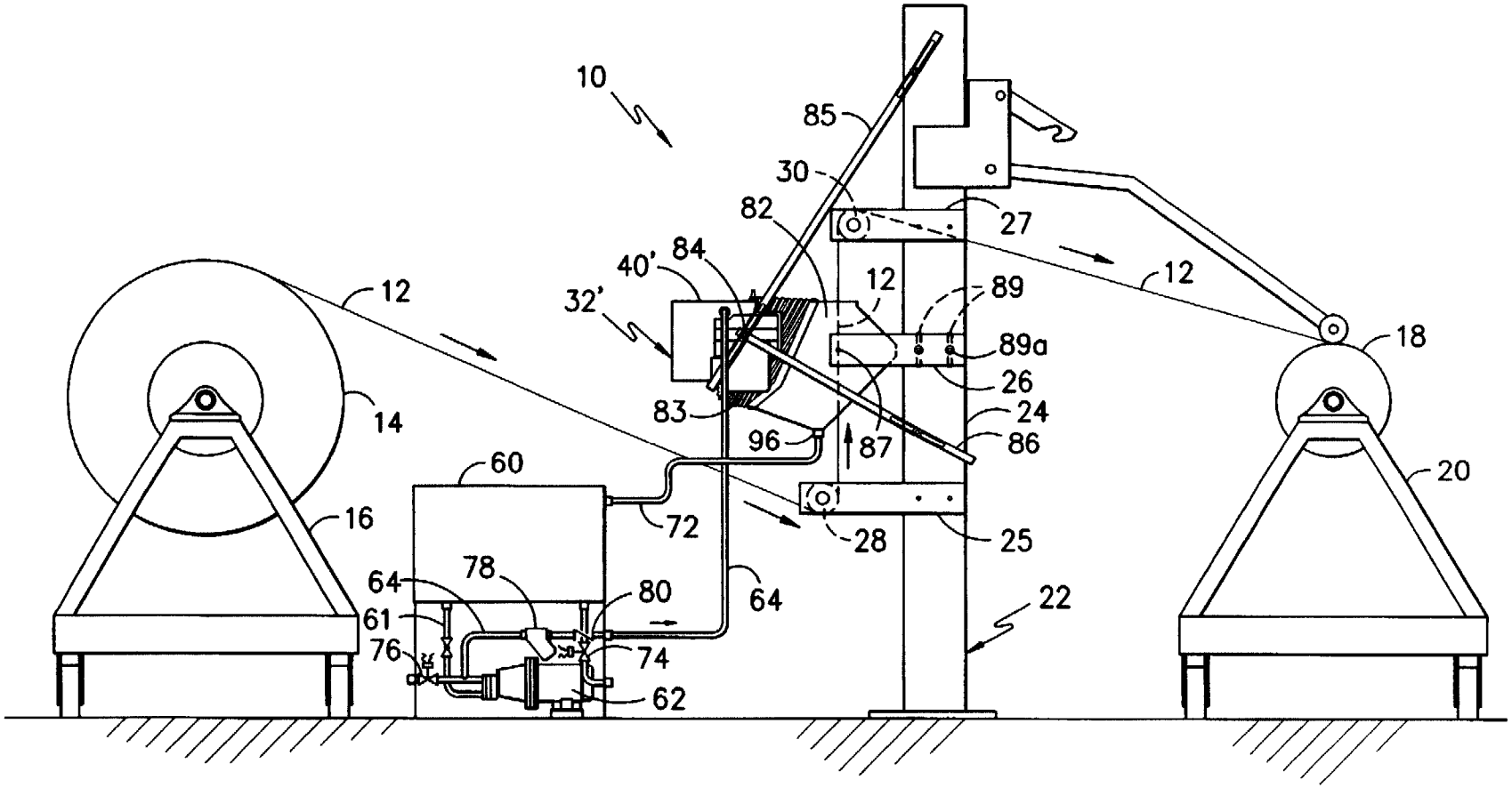
FIG. 7 is a diagrammatic side elevation view of a second embodiment of apparatus of the present invention for applying fluent material to a moving substrate, such as a continuous length sheet or fabric.
Figure 7A:
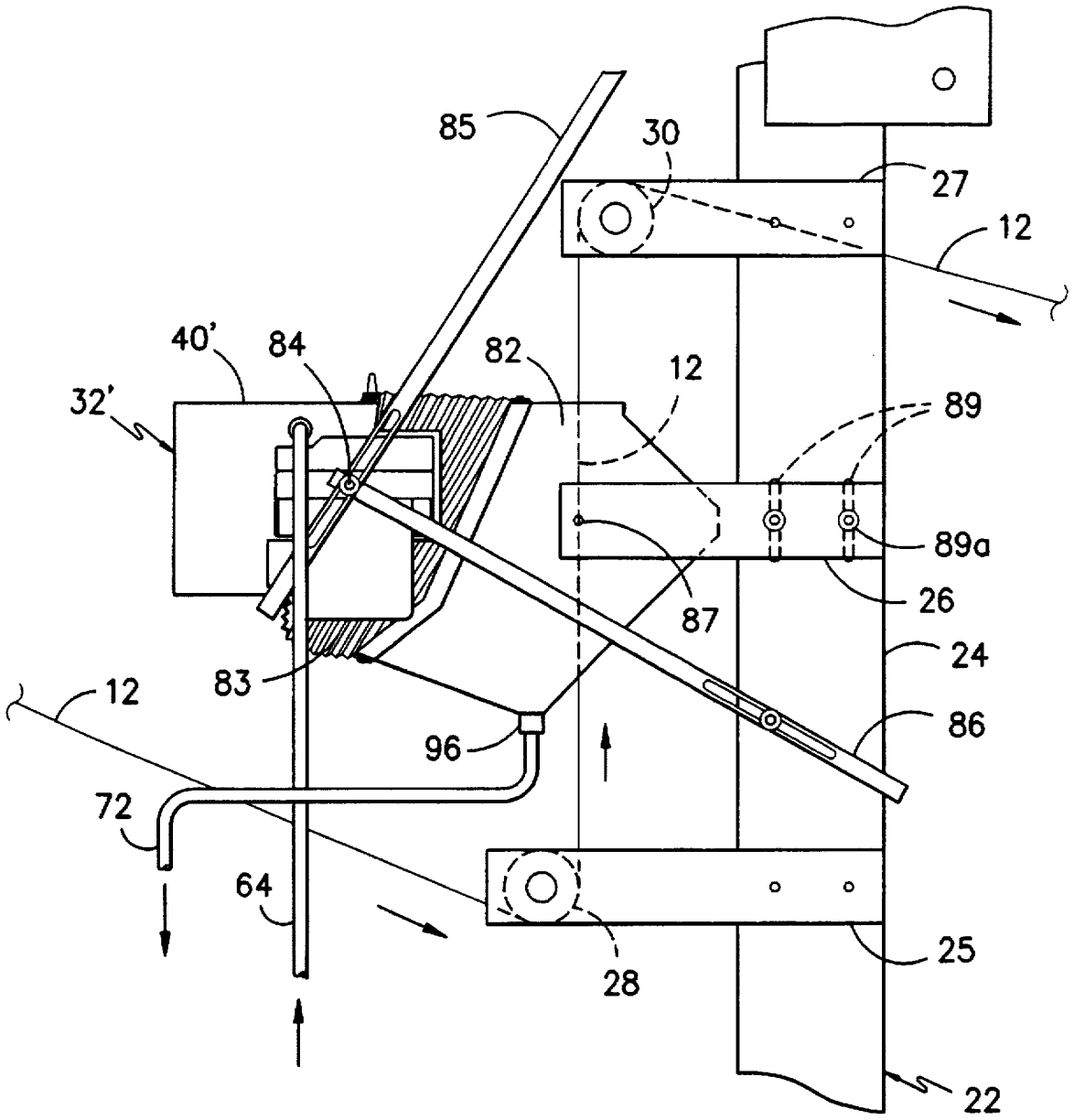
FIG. 7A is an enlarged diagrammatic side elevation view of the applicator section of the second embodiment of the invention as shown in FIG. 7.

The housing 40' containing the row of rotary spray heads is supported for rotatable adjustment about the axis of the row of spray heads on end bolts located on the end plates 41' of the housing. One such bolt 84 is shown in FIGS. 7 and 7A. The end bolts of housing 40' are attached to a pair of adjustable arms 85, 86 at each end of the housing which are mounted on the frame member 22. The shroud 82 is mounted at each end for rotational adjustment along an axis transverse to the direction of movement of the fabric by suitable end support bolts 87. The support housing and shroud enclosure may also be adjustably positioned relative to each other by means of the adjustable support arms 85, 86 of the support housing and adjustment of horizontal support member 26 along vertical slots 89 with securing bolts 89*a*.

Figure 8:
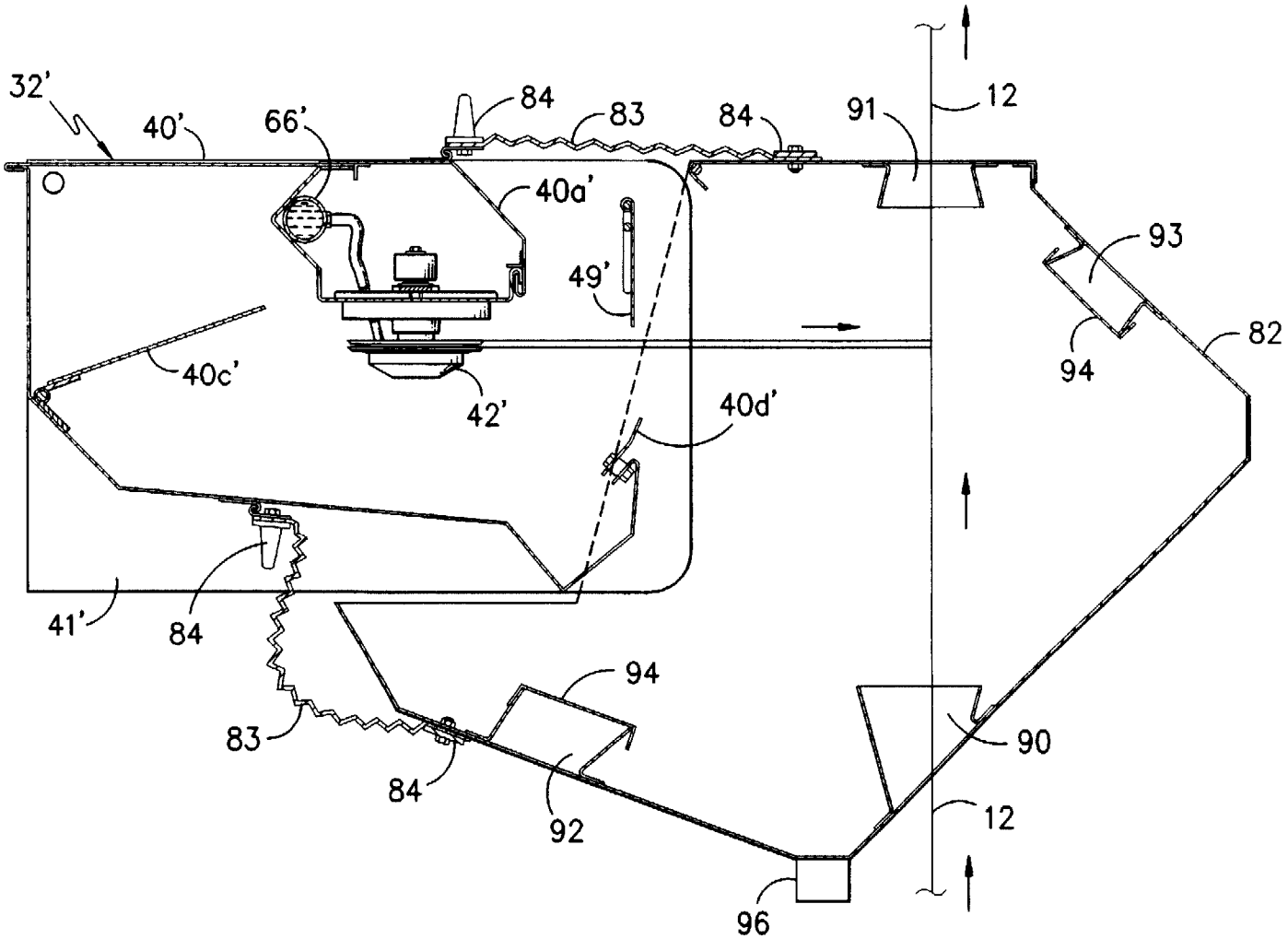
FIG. 8 is an enlarged vertical cross-sectional view of the applicator section of FIG. 7 taken centrally of its length.
Figure 9:
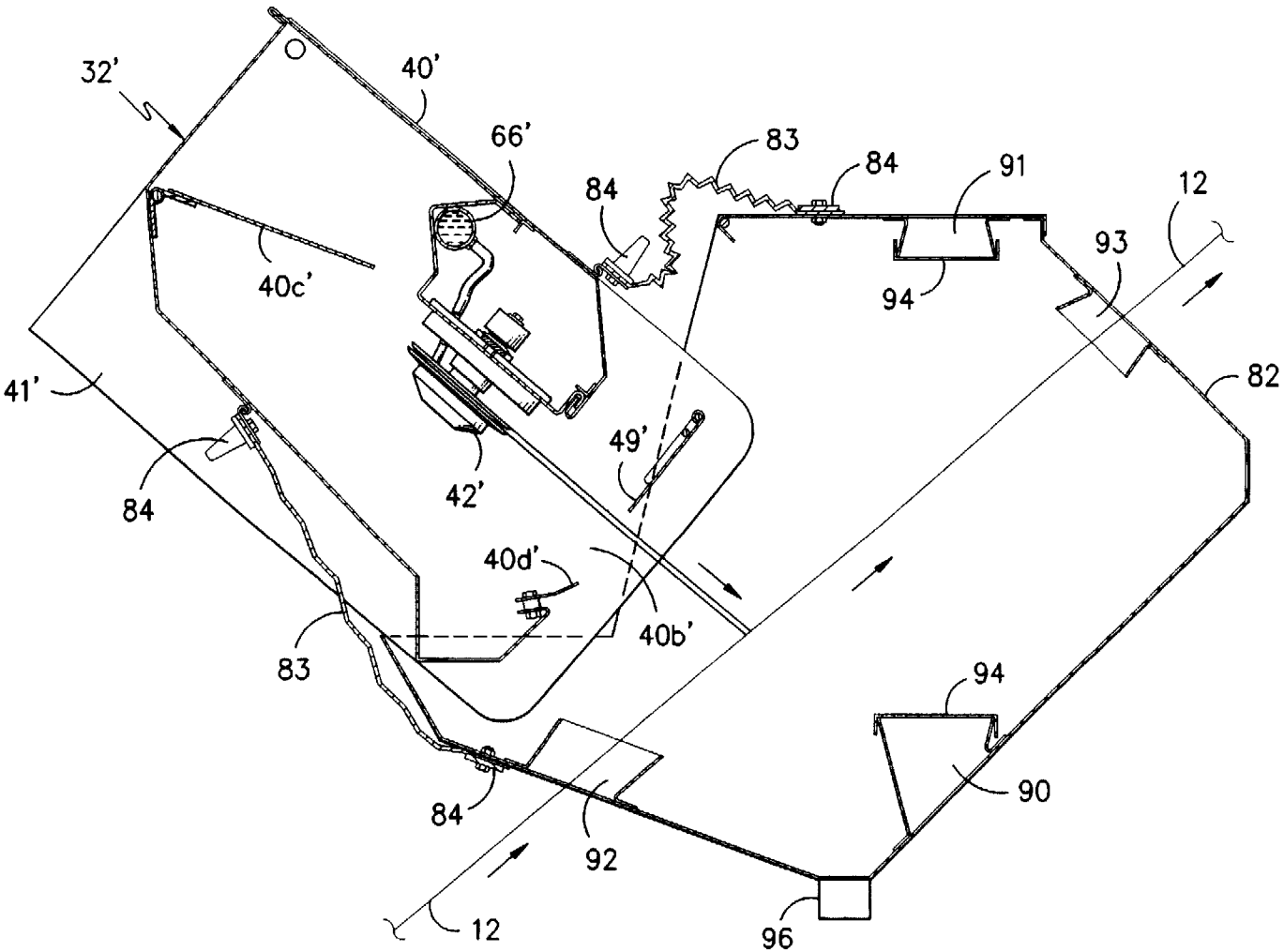
FIG. 9 is a vertical cross-sectional view of the applicator as seen in FIG. 8, but with the support housing and shroud enclosure adjustably repositioned relative to each other.
Figure 10:
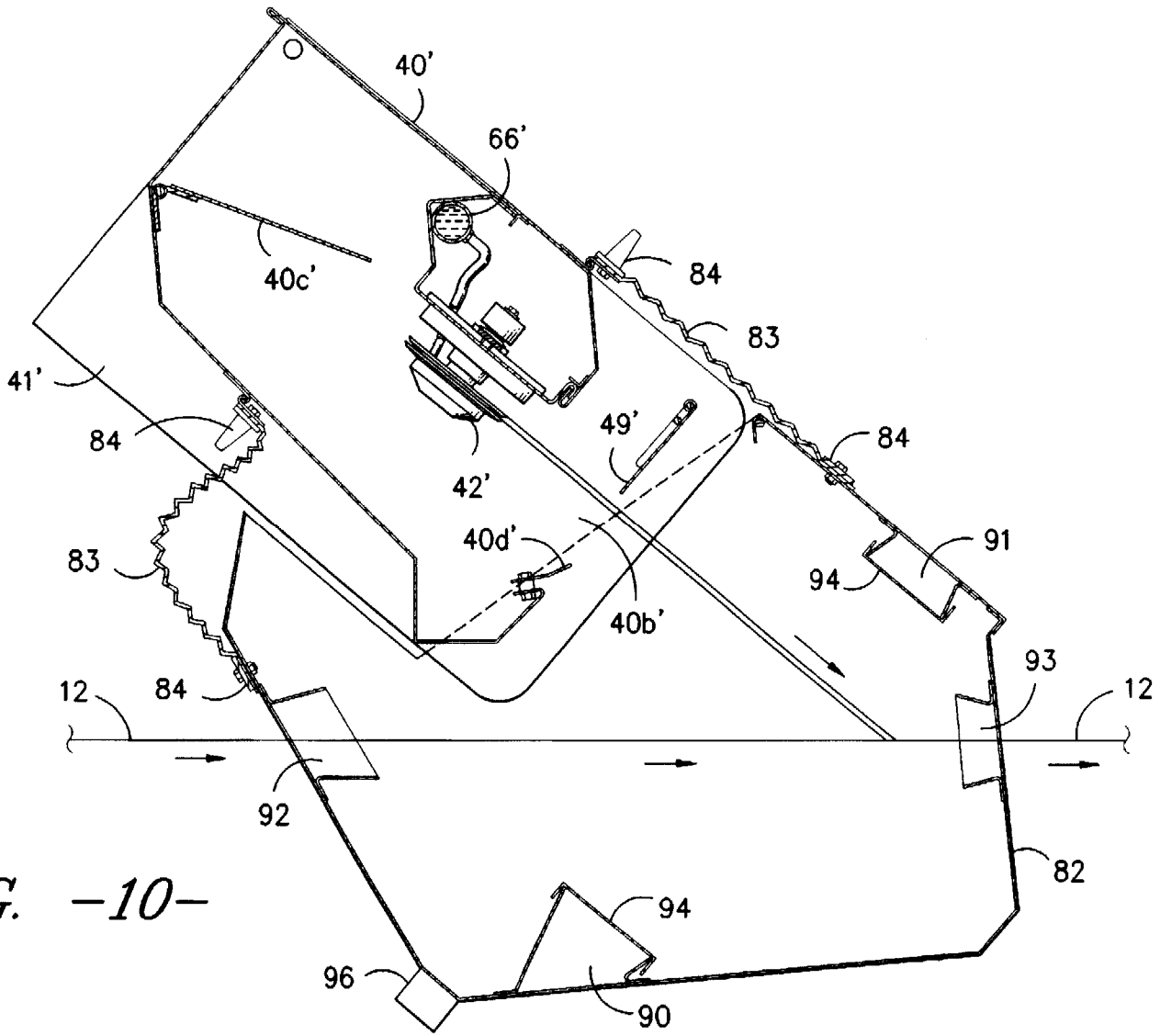
FIG. 10 is a vertical cross-sectional view, as in FIGS. 8 and 9, with the support housing and shroud enclosure further repositioned relative to each other.

As illustrated in FIGS. 8–10 which are vertical cross-sectional views of the applicator section of FIG. 7 (similar to FIG. 5), both the housing 40' and shroud enclosure 82 nay be independently angularly adjusted to accommodate any fabric path from vertical to horizontal planes. Shroud enclosure 82 is provided with two pair of flanged fabric inlet and outlet slots 90, 91 and 92, 93. Only one pair of slots is used during fabric treatment. The other pair of slots are closed and sealed by slot closure plates 94. As seen in FIGS. 8–10, slot pairs 90, 91 are employed for fabric paths from vertical to 40° off the vertical plane, while slot pairs 92, 93 are employed for fabric paths from 40° off the vertical to the horizontal plane. FIG. 8 shows the disposition of the fabric path 12 in a vertical plane with the housing section and spray heads disposed to spray treating liquid centrifugally in a horizontal plane onto the fabric surface. FIG. 9 shows adjustment of the housing 40' and shroud 82 to accommodate a fabric path 12 at an angle of 40° relative to the horizontal plane and a spray path angle of 40° off the vertical plane.

FIG. 10 shows the support housing and shroud enclosure disposed for a horizontal fabric path 12 and a 40° angle spray path off the vertical plane.

Thus, as with the first embodiment of the invention as shown in FIGS. 1–6, the applicator section 32' of the embodiment shown in FIGS. 7–10 nay be effectively employed to treat moving surfaces having different angular paths of movement, and with adjustment of the path of the spray streams relative to the movement. Excess liquid centrifugally discharged from the rotatable disc spray heads is collected in housing 40' and shroud enclosure 82, and recirculated by way of spray liquid outlets 96 in the shroud enclosure to the liquid supply tank 60 for recirculation.

Figure 11:
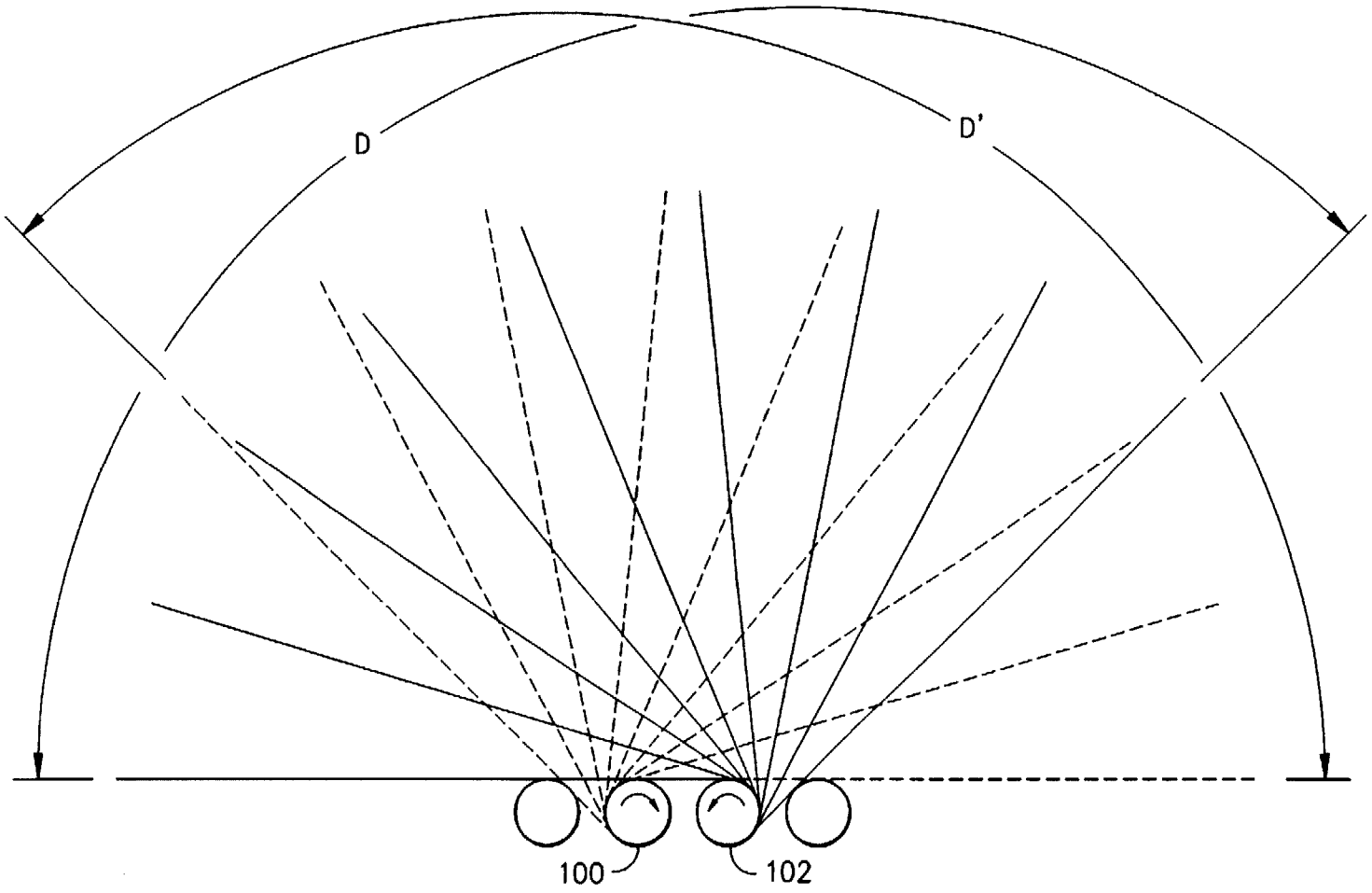
FIG. 11 is a diagrammatic illustration of the overlapping spray fields from adjacent rotary spray heads in the applicator section of the apparatus of the present invention.

FIGS. 11 illustrates diagrammatically, by computer generated drawing, the liquid spray field overlap of centrifugally discharged spray from adjacent spray heads. As seen in FIG. 11, the angular width D, D' of spray from an individual spray head 100, 102 (of 3 inch diameter, on shaft centers approximately 3½ inches apart) passing through the continuous slot of the housing is approximately 135°, such angular width being limited by the outer peripheral surfaces of its next adjacent spray heads.

Typically, the applicator section of the apparatus of the present invention may be constructed employing rotatable spray heads having 3" disc diameters rotated at a distance from the fabric of between about 8" to 12" with minimum distance between spray head rotor centers of 6" and display head rotational speeds of between about 3,000 to 5,000 rpm. As previously noted, the rotatable shafts of the spray heads may be tilted from the vertical to about 40° off the vertical without dripping of the treating liquid from the spray heads onto the fabric substrate. The plane of the substrate may be disposed either vertically or horizontally or at any angle therebetween.

That which is claimed is:

1. Apparatus for applying fluent material to a moving surface the improvement comprising a housing having an elongated continuous opening therein positioned adjacent to and extending generally transversely across the path of a moving surface, a row of rotatable spray heads mounted in said housing for rotation about parallel axes and positioned along said elongated opening, means operatively communicating with said spray heads to supply fluent material to each of the rotatable heads, means operatively connected to said rotatable heads for rotating immediately adjacent rotatable heads in the row in opposite directions to centrifugally discharge fluent material therefrom in unrestricted flow through said elongated opening and onto said moving surface, and with the rotatable heads being located such that the fluent material from each rotatable head passing through the elongated opening of the housing strikes the moving head passing through the elongated opening of the housing strikes the moving surface in multiple overlapping patterns of fluent material from multiple adjacent rotatable heads to blend the fluent material in a substantially uniform concentration across the width of the moving surface.

2. Apparatus as defined in claim 1 wherein the plurality of rotatable heads extend beyond side edges of the moving surface to apply fluent material to the side edges of the moving surface from multiple rotatable heads to maintain uniformity of deposition across the surface.

3. Apparatus as defined in claim 1 including means operatively connected to said housing and rotatable heads for angularly adjustably positioning the housing and rotational parallel axes of the rotatable heads from a vertical plane to about 40° to the vertical plane.

4. Apparatus as defined in claim 1 wherein each of the rotatable spray heads comprises at least one rotatable circular disc, the discs of the spray heads are of the same diameter, and the parallel axes of the spray heads lie in the same plane in a straight-line configuration.

5. Apparatus as defined in claim 1 including means for recirculating a portion of the fluent material to the rotating heads, and wherein said elongated opening and housing are configured to discharge approximately 40% of the recirculating fluent material through the elongated opening.

6. Apparatus for applying fluent material to a moving surface the improvement comprising a housing having an elongated continuous opening therein positioned adjacent to and extending transversely across the path of a moving surface, a row of spray heads, means for mounting the spray heads in said housing in side-by-side relation for rotation about parallel axes and positioned along said elongated opening, means to supply fluent material to each of the said spray heads, means for rotating immediately adjacent spray heads in the row in opposite directions to centrifugally discharge fluent material in a path therefrom through said elongated opening in unrestricted flow from the heads in overlapping patterns across said moving surface, a shroud operatively connected to said housing and extending across the moving surface path to receive the moving surface therethrough and to collect excess fluent material discharged from said spray heads, means operatively connected to said housing and spray heads for rotatably adjusting the housing and rotatable spray heads about the longitudinal axis of the row of spray heads to angularly adjust the path of travel of fluent material from the spray heads relative to the plane of the path of the moving surface, and means operatively connected to said shroud for rotatably adjusting the shroud about its longitudinal axis to accommodate paths of travel of the moving surface in various planes from horizontal to vertical.

7. Apparatus as defined in claim 6 wherein said shroud is operatively connected to said housing by a flexible member sealingly surrounding said housing elongated opening and an open side of the shroud to permit adjustment of the housing and shroud relative to each other.

8. Apparatus as defined in claim 7 wherein said shroud includes two pair of inlet and outlet slots for passage of the moving surface therethrough, and means for selectively closing one of the pairs to provide a passage of the moving surface through the other pair.

9. Apparatus as defined in claim 6 wherein said shroud includes fluent material outlet means for recirculating fluent material collected in the shroud to a source of supply.

10. Apparatus for applying fluent material to a moving surface the improvement comprising a plurality of rotatable spray heads, means for mounting the spray heads for rotation about parallel axes and in a row extending alongside and transversely across the path of travel of a moving surface, fluent material supply means operatively connected to said row of rotatable spray heads for supplying fluent material to each of the rotatable heads, drive means for rotating immediately adjacent rotatable heads in the row of heads in opposite directions of rotation to centrifugally expel fluent material supplied to the heads therefrom in unrestricted discharge across the moving surface in multiple overlapping patterns of fluent material to facilitate uniform application of material onto the surface.

11. Apparatus as defined in claim 10 wherein the row of rotatable heads extend beyond side edges of the moving surface to apply fluent material in overlapping patterns to the side edges of the surface to facilitate uniformity of deposition on the surface.

12. Apparatus as defined in claim 10 wherein the row of rotatable spray heads comprise more than two spray heads, and wherein the spray heads are positioned by said mounting means to apply fluent material to the moving surface by overlapping fluent material from more than two spray heads to facilitate uniformity.

* * * * *

UNITED STATES PATENT AND TRADEMARK OFFICE

CERTIFICATE OF CORRECTION

PATENT NO. : 5,795,391

DATED : August 18, 1998

INVENTOR(S) : Frederic J. Niemann; Wolfgang K.F. Otto

It is certified that error appears in the above-indentified patent and that said Letters Patent is hereby corrected as shown below:

In the title of the patent appearing on the first page of the patent, after "[54]", delete "METHOD AND".

In the Specification, column 1, line 1, delete "METHOD AND";
column 1, line 5, after "directed to", delete "method and";
column 2, line 12, after "improved", delete "method and";
column 7, line 32, "nay" should be "may";
column 7, line 64, after "surface", insert a comma;
column 8, line 38, after "surface", insert a comma;
column 9, line 10, after "surface", insert a comma.

Signed and Sealed this

Twenty-ninth Day of December, 1998

*Attest:*

Bruce Lehman

BRUCE LEHMAN

*Attesting Officer*

*Commissioner of Patents and Trademarks*